United States Patent [19]

Saito et al.

[11] Patent Number: 4,792,469

[45] Date of Patent: Dec. 20, 1988

[54] ELECTROLESS GOLD PLATING SOLUTION

[75] Inventors: Masahiro Saito; Hideyuki Takami, both of Osaka; Makoto Sato, Hirakata; Masayuki Kiso, Nagareyama, all of Japan

[73] Assignee: C. Uyemura & Co., Ltd., Osaka, Japan

[21] Appl. No.: 923,135

[22] Filed: Oct. 24, 1986

[30] Foreign Application Priority Data

Oct. 25, 1985 [JP] Japan ..... 60-239150

[51] Int. Cl.[4] ..... B05D 1/18; B22F 7/00

[52] U.S. Cl. ..... 427/443.1; 427/437; 106/1.23; 106/1.26

[58] Field of Search ..... 106/1.23, 1.26; 427/436, 437, 443.1

[56] References Cited

U.S. PATENT DOCUMENTS 4,307,136 12/1981 Tournier ..... 106/1.23

FOREIGN PATENT DOCUMENTS 2052787 10/1970 Fed. Rep. of Germany .
2750932 11/1977 Fed. Rep. of Germany .
2095292 3/1982 United Kingdom .
2121444 6/1983 United Kingdom .

OTHER PUBLICATIONS

Patent Abstracts of Japan, unexamined applications, C field vol. 9, No. 271, Oct. 29, 1985.

*Primary Examiner*—Josephine Barr
*Attorney, Agent, or Firm*—Birch, Stewart, Kolasch & Birch

[57] ABSTRACT

An amine, such as a triethanol amine or ethylenediamine is added to an alkaline electroless gold plating solution comprising a gold salt and a boron-based reducing agent to deposit a gold film having good appearance and high throwing power on a workpiece at a high deposition rate.

15 Claims, 1 Drawing Sheet

ELECTROLESS GOLD PLATING SOLUTION

BACKGROUND OF THE INVENTION

This invention relates to electroless gold plating solutions containing boron-based reducing agents.

There are known electroless gold plating solutions containing potassium gold cyanide, potassium cyanide, and potassium hydroxide and having an alkalimetal borohydride or alkylamine borane such as dimethylamine borane added as a reducing agent (see PLATING, September 1970, pages 914–920). These solutions autocatalytically produce electroless gold plated films which are substantially free of boron and thus pure and sound. The solutions are conveniently used in gold plating electronic parts or the like.

The conventional electroless gold plating solutions of this type, however, are not practical because of their slow deposition rate of the order of 0.5 μm per hour. It is strongly desired to solve the problem of slow deposition.

One solution is to add lead to accelerate deposition rate as disclosed in Japanese Patent Application Kokai No. 60-121274. Insofar as we have studied, the addition of lead not only gives rise to other problems in appearance of gold plated films and covering or throwing power, but also results in gold plated films with substantially deteriorated color tone and a steep decline of deposition rate particularly when lead is added in amounts of 10 ppm (parts per million parts) or more.

SUMMARY OF THE INVENTION

An object of the present invention is to provide a novel and improved electroless gold plating solution capable of depositing a pure and sound gold plated film having a good appearance, a tone characteristic of gold, and a high coverage in an autocatalytic manner at a high rate of deposition.

Unexpectedly, we have discovered that the addition of an amine such as triethanol amine to an alkaline electroless gold plating solution containing a boron-based reducing agent improves its deposition rate, achieving an electroless gold plating rate as high as 3 μm per hour. Even when lead is added in amounts of up to about 100 ppm, the presence of amine avoids any adverse effect of lead on appearance, throwing power and deposition rate. The amine-containing solution can efficiently produce a good gold plated film having favorable appearance at a high rate and with a high throwing power. The term throwing power denotes the extent to which all the surfaces of a workpiece to be plated are uniformly covered with a gold plated film.

Briefly stated, the present invention provides an alkaline electroless gold plating solution comprising a gold salt and a boron-based reducing agent wherein an amine compound such as an alkanol amine is blended in the solution.

BRIEF DESCRIPTION OF THE DRAWINGS

For a better understanding of the present invention, reference may be had to the following detailed description taken in conjunction with the accompanying drawings, wherein.

DETAILED DESCRIPTION OF THE INVENTION

Figure 1:
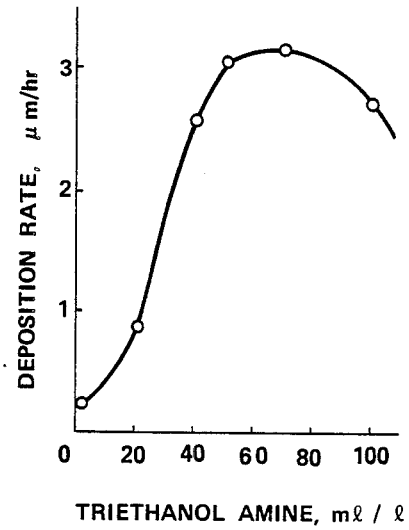
FIG. 1 is a graph showing the rate of electroless gold plating as a function of the amount of triethanol amine added.

The electroless gold plating solution of the present invention contains a gold salt and a boron-based reducing agent.

The gold salts used herein include potassium aurous cyanide, potassium auric cyanide, and sodium chloroaurate, and mixtures thereof. They are present in an amount of about 1 to 10 grams of elemental gold per liter, especially about 2 to 5 grams of elemental gold per liter of the solution.

The boron-based reducing agents used herein include borohydrides such as $KBH_4$, $NaBH_4$, etc.; and amine boranes such as dimethylamine borane, diethylamine borane, trimethylamine borane, triethylamine borane, etc., and mixtures thereof. They are present in an amount of about 0.1 to 20 grams per liter, especially about 0.5 to 10 grams per liter of the solution.

According to the feature of the present invention, one or more amines are added to the electroless gold plating solution as defined above, thereby increasing the deposition rate and throwing power of the solution and improving the appearance of gold plated films.

The amines used herein include monoalkanol amines, dialkanol amines, trialkanol amines, ethylene diamine, ethylene triamine, m-hexylamine, tetramethylene diamine, pentamethylene diamine, hexamethylene diamine, heptamethylene diamine, etc., with trialkanol amines and ethylene diamine being preferred. Most preferred is triethanol amine.

The amines are preferably added to the solution in an amount of about 1 to 200 ml per liter, especially about 10 to 100 ml per liter of the solution. Less than 1 ml/liter of amine is less effective. More than 200 ml/liter of amine rather retards deposition rate and adversely affects throwing power.

The electroless gold plating solution of the present invention may further contain any desired additive agents including cyanides, lead salts, and alkaline hydroxides.

The cyanides are effective in controlling the degradation of the plating solution and include potassium cyanide, sodium cyanide and the like, and mixtures thereof. They are preferably added in an amount of about 1 to 20 grams per liter, especially about 2 to 10 grams per liter of the solution. The solution is rather unstable with less than 1 g/liter of cyanide whereas excess cyanide results in a lower deposition rate.

The lead salts are effective in maintaining the stability of the solution and ensuring a high deposition rate. Exemplary of the lead salts there may be given lead acetate, lead citrate, lead maleate, lead phosphate, lead tartrate, lead sulfate, and mixtures thereof. They are added in an amount of 0.1 to 100 ppm, especially 0.5 to 50 ppm of elemental lead to obtain a noticeable effect. Less than 0.1 ppm of lead results in a lower deposition rate whereas more than 100 ppm of lead adversely affects throwing power and deposit appearance.

Although the broad range of lead salt is as defined above, in practice, at least 10 ppm of lead is preferably added to the plating solttion to ensure ease of maintenance and a high deposition rate. Even when 10 ppm or more lead is added, the addition of an amine to the plating solution according to the present invention can maintain gold deposition at a high rate and a high throwing power without detracting from appearance and without any trouble. This is very much preferred in the maintenance of plating solution.

The alkaline hydroxides are added to render the solution alkaline, preferably pH 12 or higher, and include potassium hydroxide and sodium hydroxide. They are preferably added in amounts of about 10 to 100 grams per liter, more preferably about 20 to 60 grams per liter of the solution.

In addition, ammonium hydroxide or other additives may be added to the plating solution of the present invention.

The conditions under which the electroless gold plating solution of the present invention is used to effect plating are not particularly limited. Preferably the plating temperature ranges from 60° to 95° C. With respect to workpieces to be plated in the solution, there may be used a variety of materials including metals such as steel, copper, and coppe alloy; and plastic and ceramic materials which are treated to provide a catalytic surface. These materials are pretreated by a conventional well-known procedure prior to electroless plating.

The electroless gold plating solution containing an amine as well as a boron-based reducing agent according to the present invention offers an improved deposition rate and throwing power and produces a pure and sound gold plated film exhibiting good appearance without leaving any little or non-plated portions.

EXAMPLES

Examples of the present invention are given below by way of illustration and not by way of limitation.

EXAMPLE 1

Electroless gold plating solutions of the following formulation were prepared.

| Ingredients | |
|---|---|
| Potassium gold cyanide | 10 gram/liter (as Au) |
| Dimethylamine borane | 1 gram/liter |
| Potassium cyanide | 10 gram/liter |
| Potassium hydroxide | 20 gram/liter |
| $Pb^{2+}$ | 15 ppm |
| Triethanol amine | as shown in FIG. 1 |
| pH 13.5 | |

Copper plates to be plated were placed in the solutions at a temperature of 70° C. to effect electroless gold plating on the copper plates. Deposition rate was examined. The results are shown in FIG. 1, which plots the deposition rate in μm/hour as a function of the concentration of triethanol amine in ml/liter.

A second series of electroless gold plating solutions having the same formulation as above except that the triethanol amine was replaced by ethylene diamine were similarly prepared and examined for deposition rate. The results are shown in FIG. 2, which plots the deposition rate in μm/hour as a function of the concentration of ethylene diamine in ml/liter.

Figure 2:
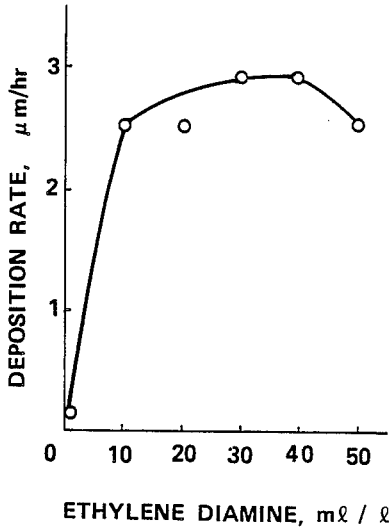
FIG. 2 is a graph showing the rate of electroless gold plating as a function of the amount of ethylene diamine added.

It is observed from FIGS. 1 and 2 that the rate of electroless gold plating is increased by the addition of triethanol amine and ethylene diamine.

EXAMPLE 2

Electroless gold plating solutions of the following formulation were prepared.

| Ingredients | |
|---|---|
| Potassium gold cyanide | 10 gram/liter (as Au) |
| Dimethylamine borane | 1 gram/liter |
| Potassium cyanide | 10 gram/liter |
| Potassium hydroxide | 20 gram/liter |
| $Pb^{2+}$ | as shown in Table 1 |
| Triethanol amine | as shown in Table 1 |
| pH 13.5 | |

Figure 3:
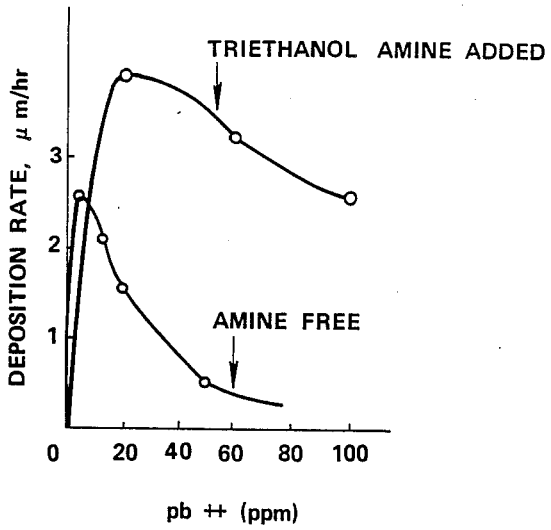
FIG. 3 is a graph showing the rate of electroless gold plating as a function of the amount of lead added for both solutions with and without triethanol amine added.

Copper plates were placed in the solutions at a temperature of 70° C. to effect electroless gold plating on the copper plates for 60 minutes. The resulting gold plated films were evaluated for appearance and throwing power according to the following criteria. The results are shown in Table 1. Deposition rate measurements are shown in FIG. 3.

Evaluation Criteria

Appearance
- O: lemon yellow
- X: brown

Throwing power
- O: good, that is, all the surfaces of a copper plate were covered with a gold deposit.
- X: bad, that is, the surfaces of a copper plate were partially uncovered with a gold deposit.

TABLE 1

| Lead | 80 ml/1 triethanol amine added | | Triethanol amine-free | |
|---|---|---|---|---|
| ($Pb^{2+}$) | Appearance | Throwing | Appearance | Throwing |
| 0 | X | X | X | X |
| 1 ppm | O | O | O | X |
| 10 ppm | O | O | O | X |
| 20 ppm | O | O | X | X |
| 50 ppm | O | O | X | X |
| 100 ppm | O | O | X | X |
| 200 ppm | X | X | X | X |
| | Invention | | Control | |

As seen from Table 1 and FIG. 3, the addition of triethanol amine provides noticeable improvements in throwing power and deposition rate and ensures a good appearance on electroless gold plated films even in the copresence of substantial amounts of lead salt.

We claim:

1. An alkaline electroless gold plating solution comprising:
- a gold salt,
- an amine borane reducing agent,
- an amine compound in an amount of from 10 to 200 ml/liter,
- elemental lead from a lead salt in an amount of from 0.1 to 100 ppm, and
- an alkaline hydroxide in an amount of from 10 to 100 grams/liter.

2. The gold plating solution as defined in claim 1, wherein said amine compound is selected from the group consisting of trialkonal amines and ethyleneamines.

3. The alkaline electroless gold plating solution as defined in claim 2, wherein said gold salt contains elemental gold in an amount of from 1 to 10 grams/liter, said amine borane reducing agent is in an amount of from 1 to 20 grams/liter, and said elemental lead from a lead salt is in an amount of from 10 to 100 ppm.

4. The alkaline electroless gold plating solution as defined in claim 3, wherein said solution further comprises a cyanide in an amount of from 1 to 20 grams/-liter.

5. The alkaline electroless gold plating solution as defined in claim 4, wherein said amine compound is selected from the gorup consisting of triethanol amine and ethylenediamine.

6. The alkaline electroless gold plating solution as defined in claim 5, wherein said amine borane reducing agent is dimethylamine borane, said amine compound is in an amount of from 10 to 100 ml/liter and said alkaline hydroxide is in an amount of from 10 to 60 grams/liter.

7. The alkaline electroless gold plating solution as defined in claim 6, wherein said amine compound is an amount of from 10 to 50 ml/liter, and said elemental lead from a lead salt is in an amount of from 10 to 50 ppm.

8. The alkaline electroless gold plating solution as defined in claim 6, wherein said amine compound is triethanol amine.

9. The alkaline electroless gold plating solution as defined in claim 6, wherein said amine compound is ethylenediamine.

10. A method of electroless gold plating which comprises:

conducting electroless gold plating on a workpiece by using an alkaline electroless gold plating solution comprising, elemental gold to form a gold salt in an amount of from 1 to 10 grams/liter, an amine borane reducing agent in an amount of from 1 to 20 grams/liter, an amine compound selected from the group consisting of trialkonal amines and ethyleneamines, elemental lead from a lead salt in an amount of from 10 to 100 ppm, and an alkaline hydroxide in an amount of from 10 to 100 grams/liter, wherein a gold plated film having a lemon yellow appearance and high throwing power is obtained on said workpiece at a high deposition rate.

11. The method as defined in claim 10, wherein said alkaline electroless gold plating solution further comprises a cyanide in an amount of 1 to 20 grams/liter and said amine compound is selected from the group consisting of triethanol amine and ethylenediamine.

12. The method as defined in claim 11, wherein said amine borane reducing agent is dimethylamine borane, said amine compound is in an amount of from 10 to 100 ml/liter, and said alkaline hydroxide is in an amount of from 10 to 60 grams/liter.

13. The method as defined in claim 12, wherein said amine compound is an amount of from 10 to 50 ml/liter, and said elemental lead from a lead salt in an amount of from 10 to 50 ppm.

14. The method as defined in claim 12, wherein said amine compound is triethanol amine.

15. The method as defined in claim 12, wherein said amine compound is ethylenediamine.

* * * * *